United States Patent [19]

Yamazaki et al.

[11] Patent Number: 5,025,237

[45] Date of Patent: Jun. 18, 1991

[54] RELAY DEVICE FOR SWITCHING RADIO FREQUENCY SIGNAL

[75] Inventors: Syoji Yamazaki, Isehara; Toshikazu Oda, Hadano; Kenji Iwanaga; Yoshitaka Gono, both of Atsugi, all of Japan

[73] Assignee: Anritsu Corporation, Tokyo, Japan

[21] Appl. No.: 411,548

[22] Filed: Sep. 22, 1989

[30] Foreign Application Priority Data

Sep. 28, 1988 [JP] Japan ..... 63-240769
Sep. 28, 1988 [JP] Japan ..... 63-240770
Aug. 28, 1989 [JP] Japan ..... 1-220676

[51] Int. Cl.[5] ..... H01H 51/22

[52] U.S. Cl. ..... 335/83; 335/78; 335/128

[58] Field of Search ..... 335/78–85, 335/128, 202

[56] References Cited

U.S. PATENT DOCUMENTS 4,879,536 11/1989 Taguchi et al. ..... 335/128

FOREIGN PATENT DOCUMENTS 59-130035 7/1984 Japan .
61-133943 8/1986 Japan .
63-69453 5/1988 Japan .
1-12362 4/1989 Japan .

*Primary Examiner*—Leo P. Picard
*Assistant Examiner*—Lincoln Donovan
*Attorney, Agent, or Firm*—Frishauf, Holtz, Goodman & Woodward

[57] ABSTRACT

Each of first and second contact blocks includes a substantially rectangular insulating member, a pair of stationary contact members projecting inward from the insulating member and supported with a predetermined interval therebetween, a movable contact member arranged between the pair of stationary contact members and supported by the insulating member, and first, second, and third terminals for electrically extracting the pair of stationary contact members and the movable contact member, respectively, and projecting from a base portion of the insulating member with predetermined intervals therebetween. An electromagnet includes a movable member for commonly acting on the movable contact members of the first and second contact blocks to move each movable contact member toward one of the pair of stationary contact members of each of the first and second contact blocks. A shielding block member with a substantially H-shaped section includes two storage spaces for storing the first and second contact blocks, respectively, a support portion for mounting the electromagnet, and a predetermined number of notched portions for guiding the first, second, and third terminals of each of the first and second contact blocks. At least a surface of the shielding block member has conductivity. A shielding case shields at least an edge of an opening portion of the shielding block member.

16 Claims, 12 Drawing Sheets

RELAY DEVICE FOR SWITCHING RADIO FREQUENCY SIGNAL

BACKGROUND OF THE INVENTION

1. Field of the Invention

The present invention relates to a relay device and, more particularly, to a radio frequency (RF) relay device constituting a switch for an RF band.

2. Description of the Related Art

In a metering system for an RF band of several GHz such as a spectrum analyzer, a standard signal generator, and a network analyzer, a programmable attenuator is used as a means for varying an RF signal level. This programmable attenuator is constituted by a plurality of stages of the RF relay devices as described above. The performance, quality, and shape of the programmable attenuator are factors having a direct influence on the metering system. Most of the factors depend on the RF relay device as a component of the system.

FIG. 13 is a side view showing a conventional RF relay device disclosed as Published Unexamined Japanese Utility Model Application No. 63-69453.

Referring to FIG. 13, reference numerals 40 denote movable contact members; and 43, terminals. Each movable contact member 40 is brought into contact with a corresponding terminal 43 to electrically switch the circuit.

Reference numeral 41 denotes a shield for covering the movable contact members 40 and the terminals 43.

The above RF relay device, however, is of a one-transfer-type in which the central terminal 43 serves as a common terminal.

In addition, an electromagnet 2 for moving the movable contact members 40 must be arranged at the side of the shield 41 along a moving direction of the movable contact members 40. Therefore, an installation area of the entire RF relay device is undesirably increased.

Furthermore, since the movable contact members 40 and the terminals 43 are brought into direct contact with each other, contact surfaces are easily abraded after switching is performed a large number of times. In addition, since a contact resistance and the like are increased accordingly, RF characteristics are adversely affected, thereby degrading the durability of the relay device.

In addition the shield 41 is notched at the central portion of the longitudinal direction of the movable contact member 40, no isolation can be obtained.

FIG. 14 is an exploded perspective view showing a main part of another conventional RF relay device disclosed as Published Unexamined Japanese Utility Model Application No. 61-133943.

Referring to FIG. 14, reference numerals 401 and 411 denote movable contact members; and 341, 351, and 361 denote terminals fixed to a shielding case 331 by an insulating member 371. The movable contact members 401 and 411 are bought into contact with the terminals 341, 351, and 361 by a moving mechanism (not shown) to electrically switch the circuit.

The shielding case 331 covers the movable contact members 401 and 411 and the terminals 341, 351, and 361.

The shielding case 331 of the above RF relay device, however, is formed to cover the movable contact members 401 and 411 and the terminals 341, 351, and 361 in consideration of only external isolation. Therefore, since such an RF relay device is not particularly arranged in consideration of a characteristic impedance between the movable contact members, the terminals, and the shielding case, its usable frequency is at most 200 MHz. For this reason, this RF relay device cannot be used for a higher frequency band (1,000 MHz or more).

In addition, since no ground terminal is provided between the shielding case and each terminal, no isolation can be obtained.

Furthermore, if an electromagnet is arranged at the side of the shielding case in a horizontal plane, an installation area of the entire RF relay device is undesirably increased.

Note that the conventional RF relay device as shown in FIG. 13 or 14 is of a printed circuit board mounting type which can be mounted on a printed circuit board. However, a use frequency band of the above conventional RF relay device cannot reach an RF band of several GHz, and its reliability including reproducibility is poor.

SUMMARY OF THE INVENTION

It is, therefore, an object of the present invention to provide a new and improved relay device for a radio frequency signal which can extend a use frequency band to an RF band of several GHz or more and can improve the reliability including reproducibility. More specifically, according to the RF relay device of the present invention, high durability for mounting the device on a printed circuit board can be obtained, a plurality of transfers can be switched by a single electromagnet, a plurality of transfers can be isolated from each other to realize a plurality of transfers in a single relay device, an installation area of the device can be reduced, isolation between the terminals can be obtained, and a characteristic impedance of the circuit inside the shielding case can be maintained at a predetermined value.

According to one aspect of the present invention, there is provided a relay device for switching a radio frequency signal, the device comprising:

first and second contact blocks each having a substantially rectangular insulating member, a pair of stationary contact members projecting inward from the insulating member and supported with a predetermined interval therebetween, a movable contact member arranged between the pair of stationary contact members and supported by the insulating member, and first, second, and third terminals for electrically extracting the pair of stationary contact members and the movable contact member, respectively, and projecting from a base portion of the insulating member with predetermined intervals therebetween;

an electromagnet having a movable member for commonly acting on the movable contact members of the first and second contact blocks to move each movable contact member toward one of the pair of stationary contact members of each of the first and second contact blocks;

a shielding block member with a substantially H-shaped section, having two storage spaces for storing the first and second contact blocks, respectively, a support portion for mounting the electromagnet, and a predetermined number of notched portions for guiding the first, second, and third terminals of each of the first and second contact blocks, at least a surface of the shielding block member having conductivity; and a shielding case for shielding at least an edge of an opening portion of the shielding block member.

According to another aspect of the present invention, there is provided a high frequency relay device comprising:

first and second contact blocks each having an insulating member integrally incorporating a pair of stationary contact plates, a movable contact spring, and terminals, and having a contact member at a contact portion of each contact;

an electromagnet having a movable member for displacing a free end of the movable contact spring of each of the first and second contact blocks toward one of the stationary contact plates;

a block member formed to have a substantially H-shaped section, having a plurality of ground terminals, having an electromagnet on an upper surface thereof, storing the first and second contact blocks in first and second storage spaces formed therein, respectively, and having a shielding wall for isolating the first and second contact blocks; and a conductive shielding case for covering outer surfaces of the first and second blocks, the electromagnet, and the block member.

The block member and the shielding case may be electrically connected by connecting means. In addition, a bottom case may be formed on the lower surface of the block member to close an opening portion defined between the bottom case and a peripheral portion of the shielding case.

With the above arrangement, the stationary contact plates and the movable contact springs exposed on the surfaces of the first and second contact blocks are arranged in the first and second storage spaces defined inside the block member formed to have an H-shaped section and grounded via the ground terminals. The first and second storage spaces are isolated from each other by a shielding wall. Therefore, the first and second storage spaces are not adversely affected by electromagnetic have interference between the first and second contact blocks or an electromagnetic field of the electromagnet and can be maintained under constant conditions. In addition, since the shielding case is adopted, the RF relay device is not subjected to interference of an unnecessary electromagnetic wave present outside the device.

Furthermore, the pair of stationary contact plates and the movable contact spring have the contact members. Therefore, since the contact members are directly brought into contact with each other, abrasion can be prevented, and a contact resistance or the like does not change, thereby improving durability of the contact portions.

Moreover, since the electromagnet for generating an intense magnetic field can be arranged above the shielding block, a two-transfer type RF relay device can be obtained with a small installation space.

According to still another aspect of the present invention, there is provided a shielding block structure for switching an RF frequency, comprising:

first and second contact blocks each having an insulating member integrally incorporating a pair of stationary contact plates, a movable contact spring, and a plurality of terminals; and a block member formed to have a substantially H-shaped section in order to obtain storage spaces for storing the first and second blocks and having through grooves, wherein predetermined intervals are maintained from the stationary contact plates and the movable contact springs of the first and second contact blocks to the opposing block member and from the plurality of terminals of the first and second contact blocks to the opposing block member, thereby maintaining a predetermined characteristic impedance. Therefore, a switch can be used for a higher frequency band. In addition, since a plurality of ground terminals are formed integrally with the block member in the same direction as the plurality of terminals, isolation between the terminals can be obtained.

Furthermore, since the block member includes step portions and projections, storage positions of the first and second contact blocks can be determined. Therefore, the predetermined characteristic impedance can be maintained.

With the above arrangement, the stationary contact plates and the movable contact springs exposed on the surfaces of the contact blocks are arranged in the first and second storage spaces defined inside the H-shaped block member so as to be separated from the block member by a predetermined distance capable of obtaining a predetermined characteristic impedance. Therefore, the predetermined characteristic impedance can always be maintained. In addition, since the plurality of terminals of the contact blocks are inserted in the through grooves of the block member with a predetermined distance therebetween, a predetermined characteristic impedance can be maintained. In order to reliably obtain this effect, the step portions and the projections formed on the block member determine relative positions of the first and second contact blocks with respect to the block member.

As a result, since the characteristic impedance can be maintained at a predetermined value, the RF relay device can be applied to a switch for a higher frequency band.

In addition, since the ground terminals are molded integrally with the block member, isolation between the plurality of terminals of each contact block can be obtained by the ground terminals.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention and, together with the general description given above and the detailed description of the preferred embodiments given below, serve to explain the principles of the invention.

FIG. 13 is a cross sectional view showing a conventional RF relay device; an

DETAILED DESCRIPTION OF THE PREFERRED EMBODIMENTS

Figure 1:
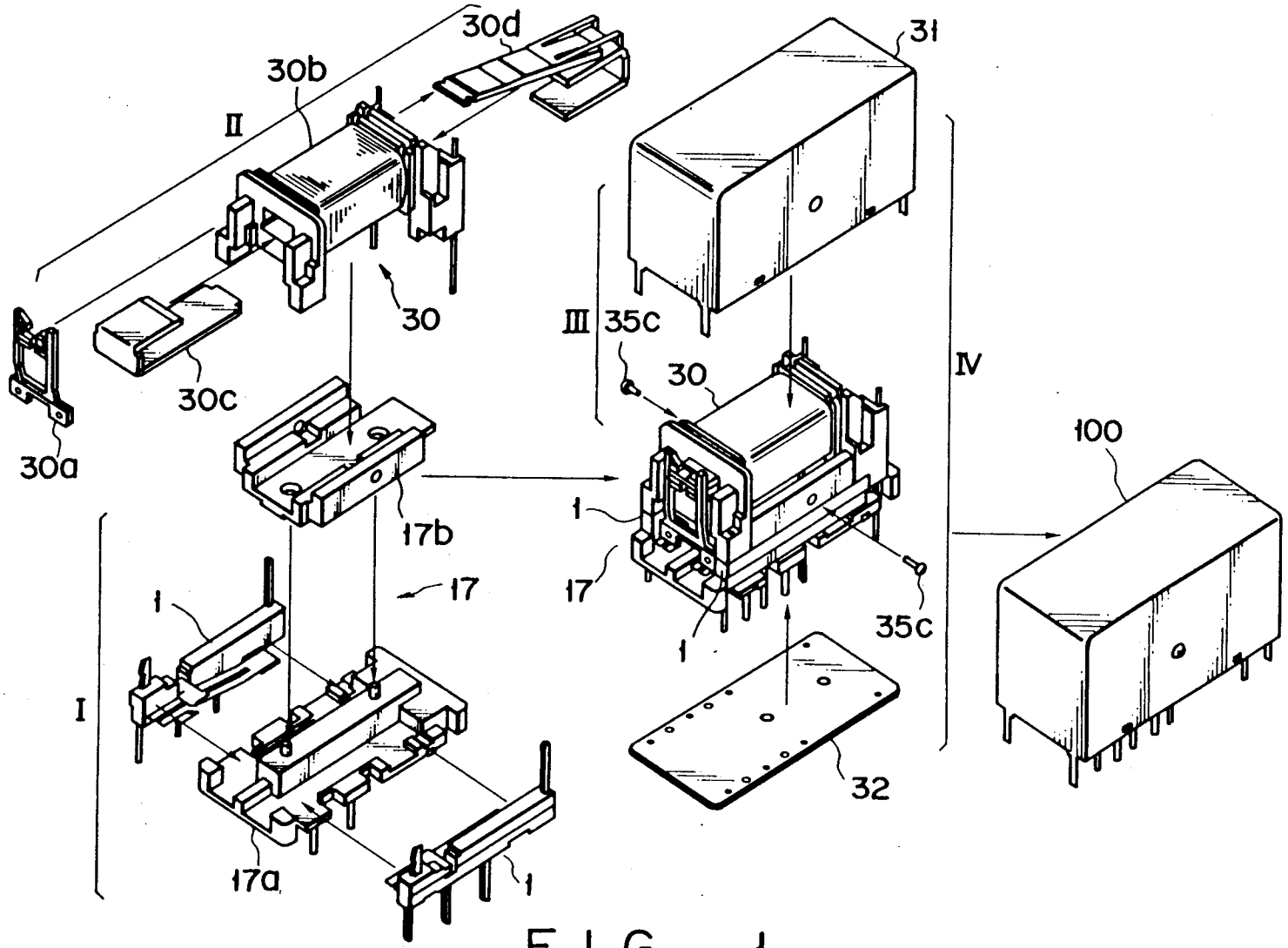
FIG. 1 is an exploded perspective view showing an RF relay device according to an embodiment of the present invention.

FIG. 1 is an exploded perspective view showing an RF relay device according to an embodiment of the present invention.

That is, this embodiment provides an RF relay device 100 comprising a shield/contact block assembly part I, an electromagnet assembly part II, a shielding case assembly part III, and a bottom case assembly part IV. The parts I, II, III, and IV will be described below in the order named. Note that for the descriptive convenience, a description order will be partially reversed, and some parts will be repeatedly described.

Figure 2:
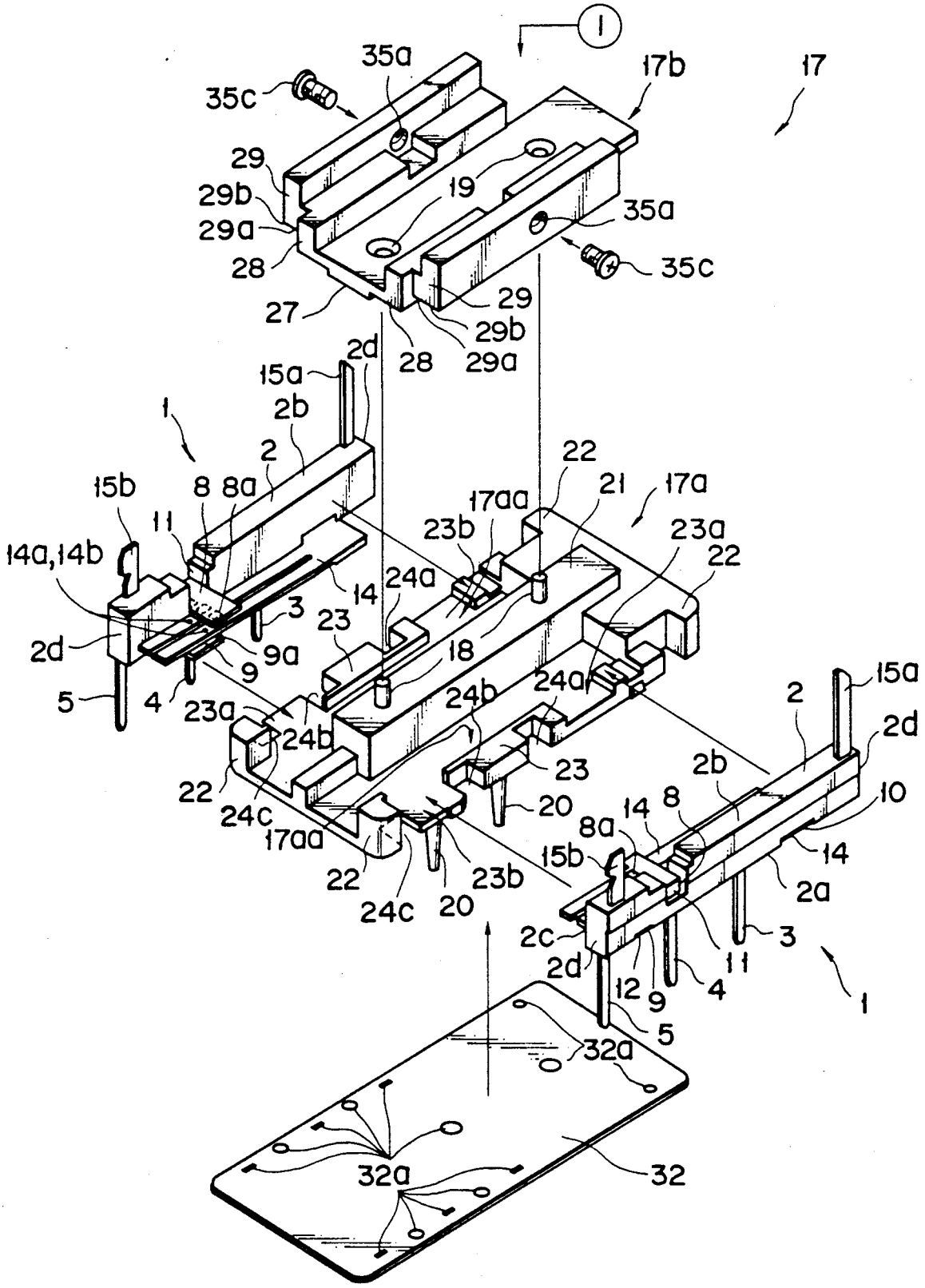
FIG. 2 is an exploded perspective view showing in detail a part I shown in FIG. 1.

FIG. 2 is an exploded perspective view showing the shield/contact block assembly part I shown in FIG. 1. Referring to FIG. 2, each of a pair of contact blocks 1 is obtained by electrically connecting a terminal 3 to a movable contact spring 14 each making of a good conductor such as phosphor bronze, a terminal 4 to a stationary contact plate 8, and a terminal 5 to a stationary contact plate 9, respectively, and molding these components in a substantially rectangular parallelepiped insulating member 2 making of, e.g., a synthetic resin prepared by mixing glass fibers in a polycarbonate base material.

The movable contact spring 14 and the stationary contact plate 9 are arranged in notches 10 and 12 formed in a surface 2*a* as the lower surface of the insulating member 2 from which the terminals 3, 4, and 5 project, and the stationary contact plate 8 is arranged in a notch 11 formed in a surface 2*b* as its upper surface. The movable contact spring 14 and the stationary contact plates 8 and 9 project outward from the notches 10 to 12 so as to be substantially parallel to the lower surface 2*a*.

That is, the movable contact spring 14 and the stationary contact plates 8 and 9 are bent through a right angle so as to be substantially parallel to the lower surfaces 2*a* of the notches 10, 11, and 12, respectively. Therefore, the two contact plates 8 and 9 oppose each other at the side of a surface 2*c* neighboring the lower and upper surfaces 2*a* and 2*b* so as to vertically sandwich the insulating member 2.

The free end of the movable contact spring 14 is located between the two stationary contact plates 8 and 9 and normally in contact with the upper plate 8 by its elasticity. Contact members 8*a* and 9*a* each making of a gold, silver, or nickel alloy is fixed to opposing surfaces of the contact plates 8 and 9, respectively. Contact members 14*a* and 14*b* coated with gold are fixed to the upper and lower surfaces of the movable contact spring 14 at positions corresponding to the contact members 8*a* and 9*a*, respectively.

Projecting pieces 15*a* and 15*b* each having a predetermined height are formed at both ends of the upper surface 2*b* of the insulating member 2. The projecting pieces 15*a* and 15*b* are members for positioning an electromagnet to be described later.

A shielding block body 17 comprises a lower block 17*a* and an upper block 17*b*. The lower and upper blocks 17*a* and 17*b* are assembled to have a substantially H-shaped side surface by fitting and fixing two pins 18 projecting from an upper surface central portion of the lower block 17*a* into holes 19 formed in a central portion of the upper block 17*b*.

At least the surface of the block body 17 comprising the upper and lower blocks 17*a* and 17*b* consists of a good conductor. In this embodiment, a material obtained by under-plating copper on the surface of a molded product making of a zinc die-cast and performing nickel-plating thereon is used. However, a material obtained by performing metal-plating on the surface of a plastic molded product may be used.

A plurality of (e.g., six) ground terminals 20 are formed on the bottom surface of the lower block 17*a*, integrally molded by a zinc die cast, for example. A shielding wall 21 is formed at a central portion on the upper surface of the lower block 17*a* along its longitudinal direction so that the lower block 17*a* is formed substantially line-symmetrical about the wall 21.

Projections 22 each having a predetermined height are formed at four corners of the lower block 17*a*. Each pair of projections 22 at an end in the longitudinal direction is continuously formed to have the same height.

Side walls 23 each having a predetermined height are formed along the edges in the longitudinal direction of the lower block 17*a*. The side walls 23 position the surface 2*a* of the insulating member 2 in the assembly of the contact block 1. Notches 23*a* and 23*b* for maintaining a characteristic impedance between a part of the movable contact spring 14 exposed on the lower surface of the contact block 1 and the stationary contact plate 9 constant are formed in each side wall 23.

Through grooves 24*a*, 24*b*, and 24*c* through which the terminals 3 to 5 of the contact block 1 extend are formed in each side wall 23. The grooves 24*a* to 24*c* are formed around the terminals 3 to 5 such that a predetermined distance is formed between the grooves 24*a* to 24*c* and the terminals 3 to 5, respectively. The grooves 24*a* to 24*c* are formed in order to maintain a predetermined RF characteristic impedance (e.g., 50 Ω) between the grooves 24*a* to 24*c* and the terminals 3 to 5, respectively. Note that the shape of the grooves 24*a* to 24*c* need not be rectangular as in this embodiment but may be circular.

The upper block 17*b* will be described below. The upper block 17*b* has a bottom portion 27 which is continuously in contact with the shielding wall 21 of the lower block 17*a*, and two pairs of step portions 28 and 29 extending outward from the bottom portion 27 to form a U shape. The step portions 29 are located above the side walls 23 of the lower block 17*a* with a predetermined distance therebetween and position the upper surface 2*b* of the insulating member 2 of the contact block 1.

Figure 6A:
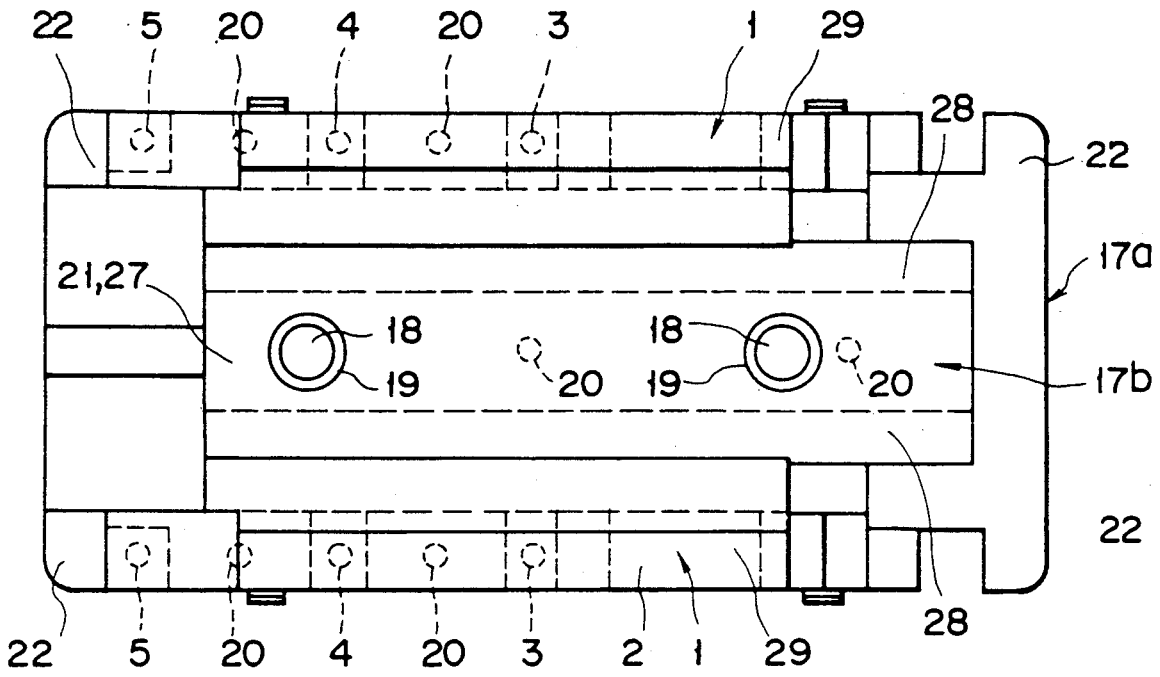
FIGS. 6A, 6B, and 6C are plan, front, and side views, respectively, showing a main part shown in FIG. 1.
Figure 6B:
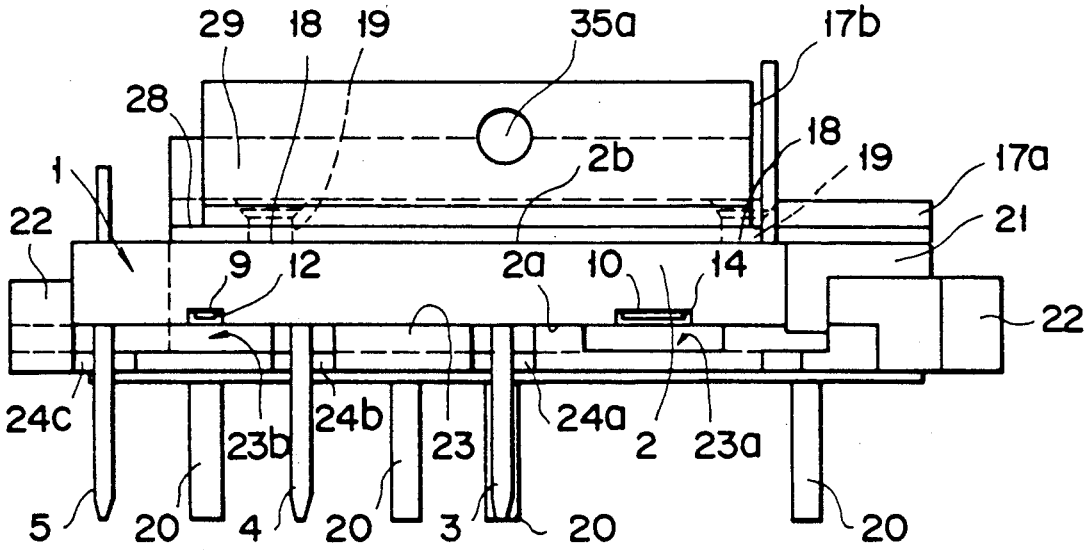

The shield/contact block assembly part I consisting of the pair of contact blocks 1 and the shielding block body 17 having the above arrangements is assembled in directions indicated by arrow in FIGS. 1 and 2. As a result, the shielding/contact block assembly part I is assembled as shown in plan, front, and side views shown in FIGS. 6A, 6B, and 6C, respectively.

Figure 6C:
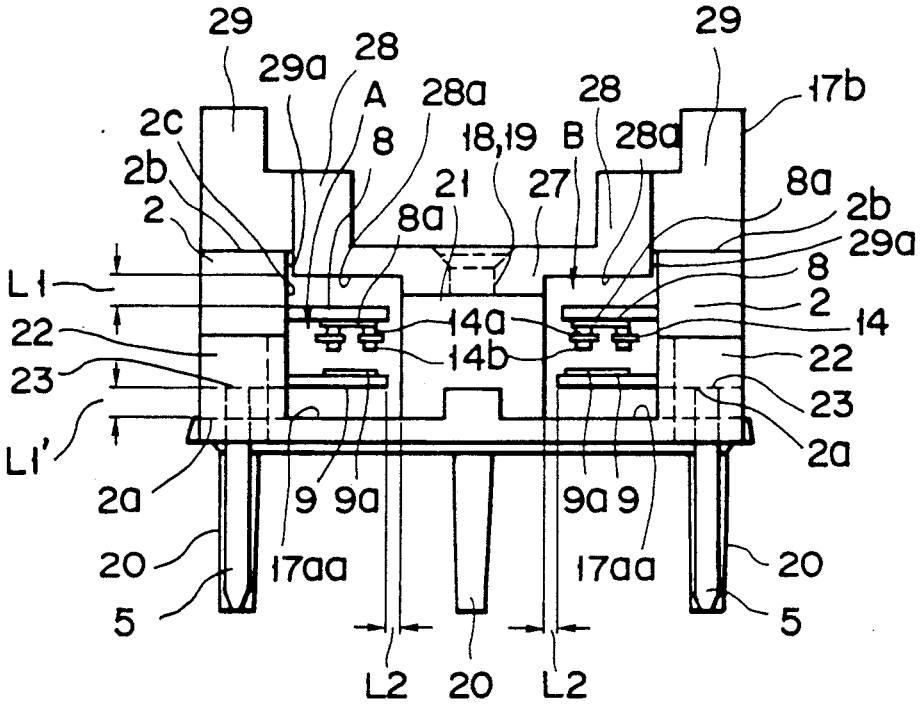

As shown in FIG. 6C, the shielding block body 17 is assembled to define an H shape having storage spaces A and B. The symmetrical contact blocks 1 are stored in the storage spaces A and B defined at both the sides of the shielding wall 21 formed on the shielding block body 17.

More specifically, the upper surface 2*a* of the insulating member 2 constituting the contact block 1 is located on the side wall 23 of the shielding block body 17, and its lower surface 2*b* is positioned on the lower surface of the step portion 29. At this time, as shown in FIG. 6C, the contact blocks 1 and the shielding contact plate 8 is separated from the lower surface 28*a* of the step portion 28 of the upper block 17*b* by an interval L1 and the stationary contact plate 9 is separated from an upper surface 17*aa* of the lower block 17*a* by an interval L1' in each of the storage spaces A and B. Note that the distances L1 and L1' are equally set to about 1 to 1.5 mm so as to maintain a predetermined RF characteristic impedance (e.g., 50 Ω) between the stationary contact plates 8 and 9 and the shielding block body 17, respectively.

Step portions 29*a* are formed on the lower surfaces of the step portions 29 of the shielding block body 17. The contact blocks 1 and the block body 17 are formed such that when the surfaces 2*c* of the insulating members 2 of the contact blocks 1 are brought into contact with the step portions 29*a*, each interval L2 from the stationary contact pates 8 and 9 and the movable contact spring 14 to the shielding wall 21 is automatically set to a predetermined value. Note that the distance L2 is set to about 0.2 mm in order to maintain a predetermined RF characteristic impedance (e.g., 50 Ω) in an edge line. In addition, the surfaces 2*d* present in the longitudinal direction of the contact blocks 1 are brought into contact with the projections 22 to position the contact block 1 in the longitudinal direction, thereby maintaining the predetermined distance from the terminals 3, 4, and 5 to the through grooves 24*a*, 24*b*, and 24*c*, respectively.

Figure 3:
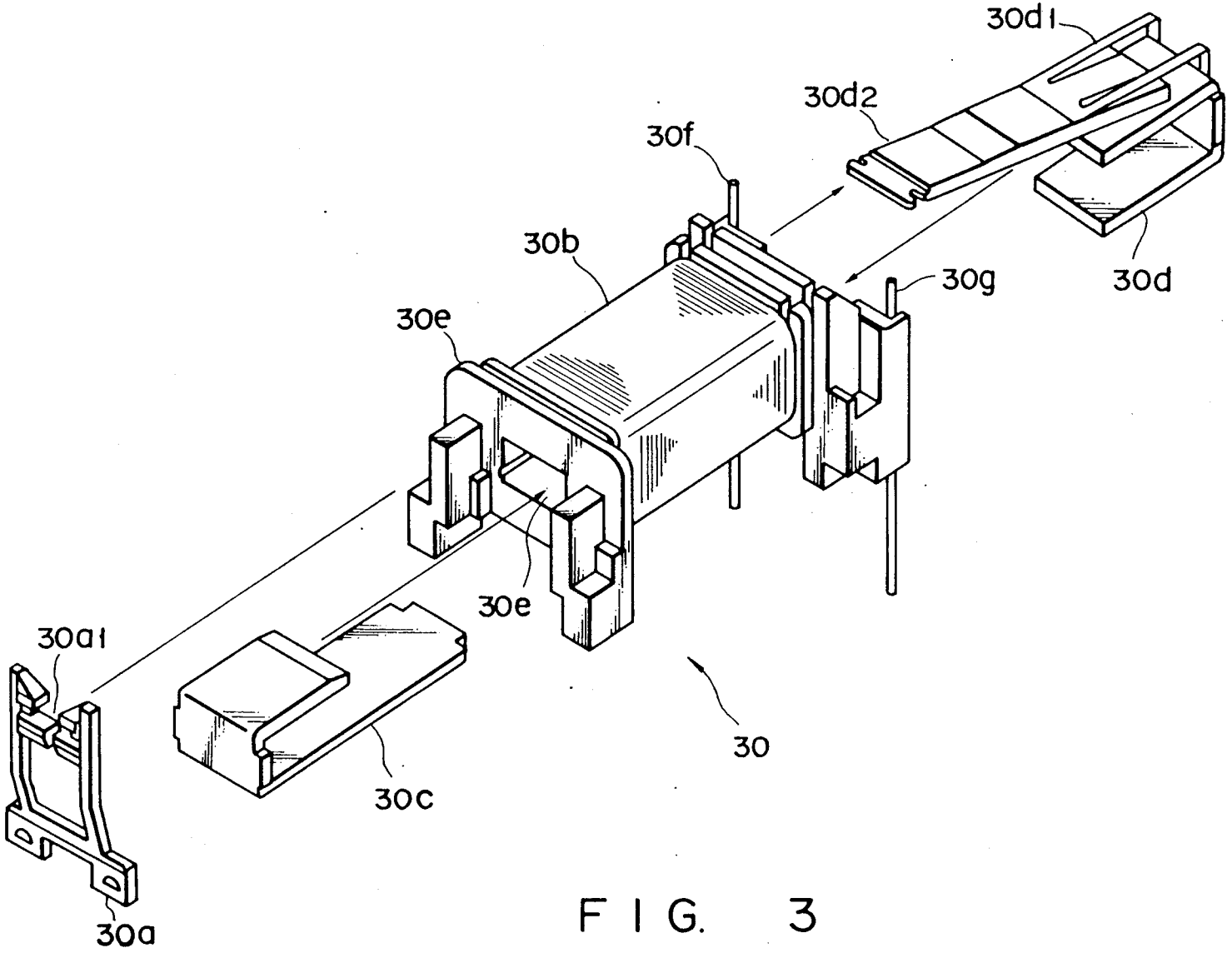
FIG. 3 is an exploded perspective view showing in detail a part II shown in FIG. 1.

FIG. 3 is an exploded perspective view showing the electromagnet assembly part II shown in FIG. 1. Referring to FIG. 3, a coil 30*b* is wound around a coil bobbin 30*e* having a hollow portion 30*e*1, and terminals 30*f* and 30*g* connected to the coil 30*b* are located at both sides of one end portion of the coil bobbin 30*e*. A first yoke 30*d* with a U-shaped side surface having an armature 30*d*2 flexibly supported via an elastic support 30*d*1 is inserted from one end of the hollow portion 30*e*1 of the coil bobbin 30*e*, and a second yoke 30*c* with a J-shaped side surface is inserted from its other end. The first and second yokes 30*d* and 30*c* form a magnetic circuit. When the magnetic circuit is excited by the coil 30*b*, the armature 30*d*2 is attracted to the short side of the second yoke 30*c*. The distal end of the armature 30*d*2 is supported at its portion projecting from the other end of the hollow portion 30*e*1 by a support portion 30*a*1 of a movable member 30*a*. In this manner, a maximum displacement amount of the armature 30*d*2 is transmitted to the movable member 30*a*. As will be described later, both sides of a lower portion of the movable member 30*a* are arranged to oppose the distal ends of the movable contact springs 14 of the contact blocks 1 when the electromagnet assembly part II is assembled in the shielding/contact block assembly part I so that they urge the distal ends of the movable contact springs 14 by a displacing force transmitted from the armature 30*d*2 when the coil 30*b* is energized. An electromagnet 30 having the movable member 30*a* is thus provided.

Figure 4:
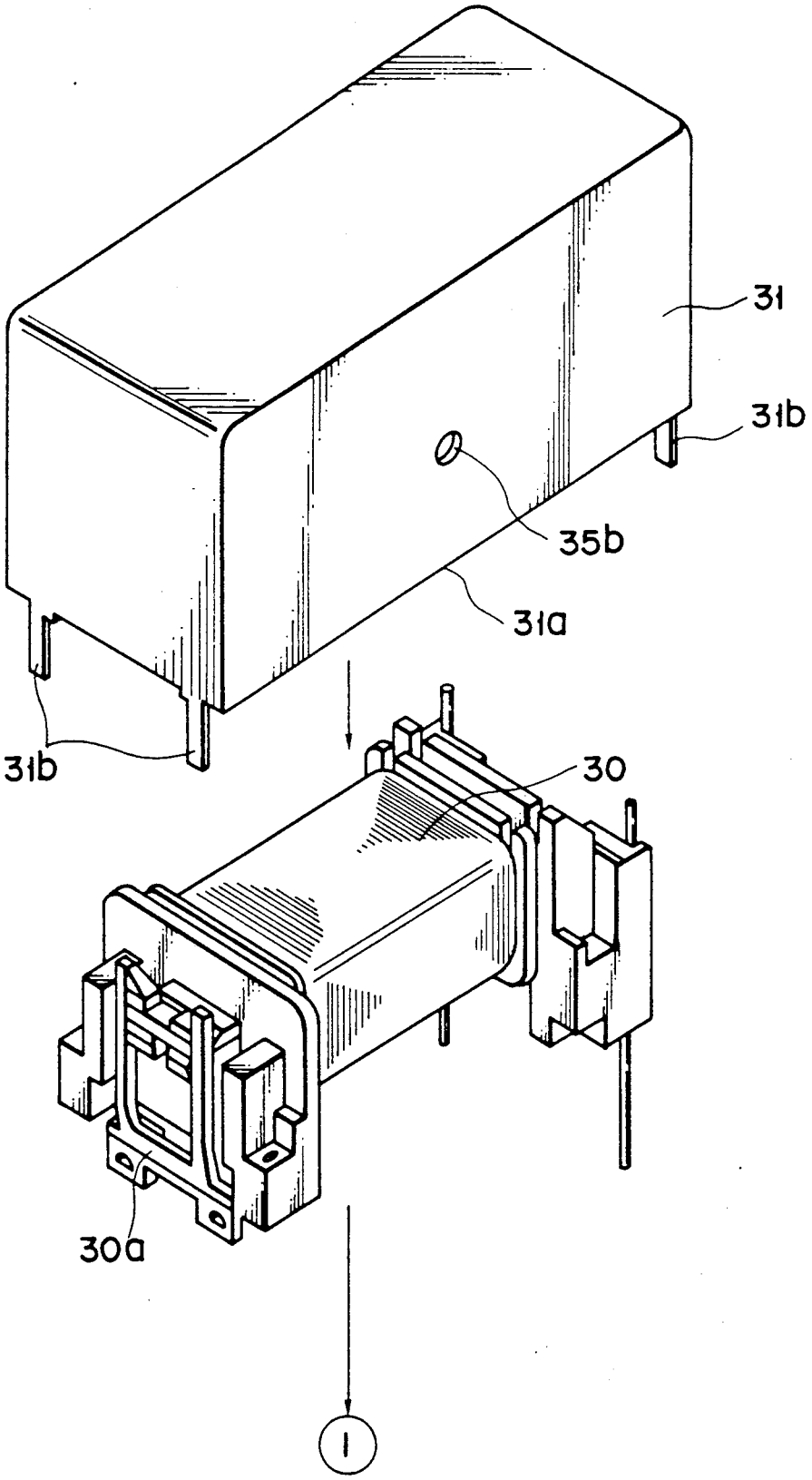
FIG. 4 is an exploded perspective view showing in detail a part III shown in FIG. 1.
Figure 7C:
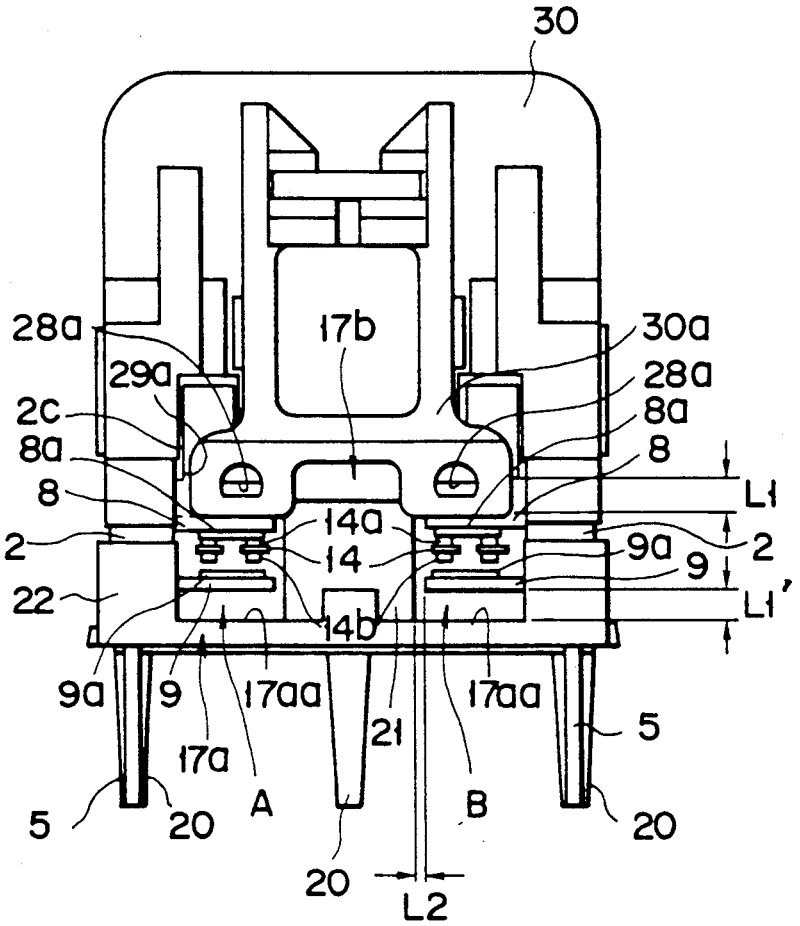
FIGS. 7A, 7B, and 7C are plan, front, and side views, respectively, of another main part shown in FIG. 1.
Figure 7A:
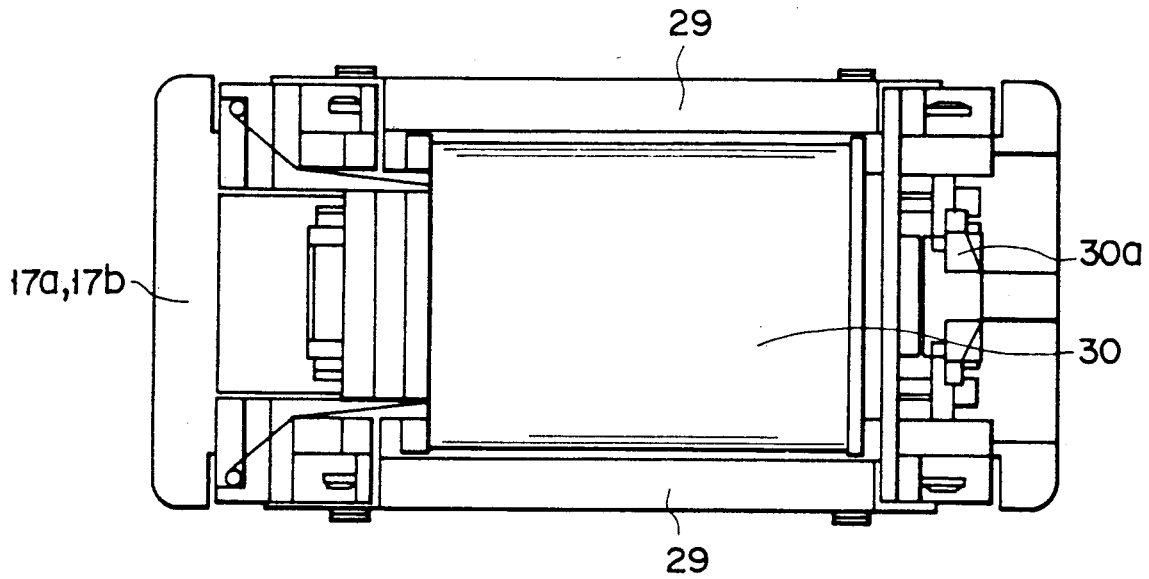
Figure 7B:
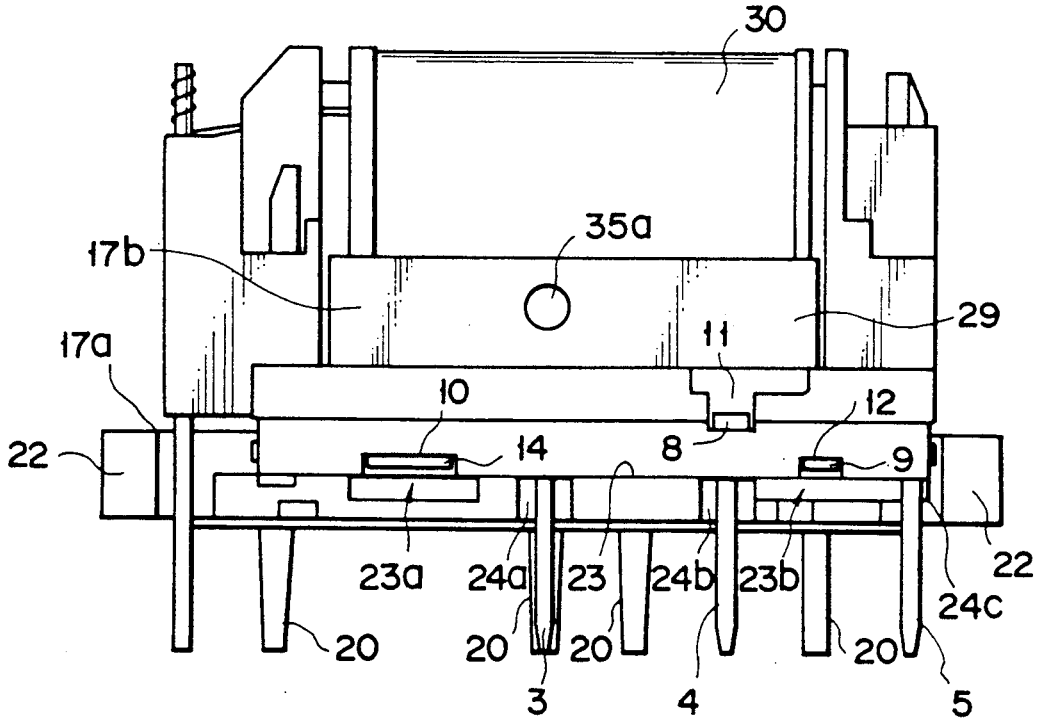

As shown in FIG. 2 and a line I—I in FIG. 4, the electromagnet 30 as a driving means for driving the movable contact springs 14 is arranged on the upper surface of the shielding block body 17. The movable member 30*a* of the electromagnet 30 is brought into contact with and moves the movable contact springs 14 between the stationary contact plates 8 and 9. FIGS. 7A, 7B, and 7C are plan, front, and side views corresponding to FIGS. 6A, 6B, and 6C, respectively, showing a state in which the shielding/contact block assembly part I is assembled with the electromagnet assembly part II.

FIG. 4 is an exploded perspective view showing the shielding case assembly part III shown in FIG. 1. Referring to FIG. 4, reference numeral 31 denotes a box-like (width 13 mm, height 14.5 mm and length 26 mm) shielding case having, at its opening edge portions 31*a* opposing in the longitudinal direction, a plurality of (in FIG. 4, two at each edge portion, i.e., a total of four) ground terminals 31*b*. In addition, through holes 35*b* for a connecting mechanism 35 are formed in both side portions opposing in the lateral direction of the shielding case 31. The connecting mechanism 35 electrically closes or connects between the shielding case 31 and the block body 17. The connecting mechanism 35 threadably fixes screw holes 35*a* and the through holes 35*b* formed in the side portions of the upper block 17*b* and the shielding case 31, respectively, by screws 35*c*. The connecting mechanism 35 is not limited to that of the above embodiment but may be arranged such that a recess portion to receive a projection is formed in the shielding case.

Figure 5:
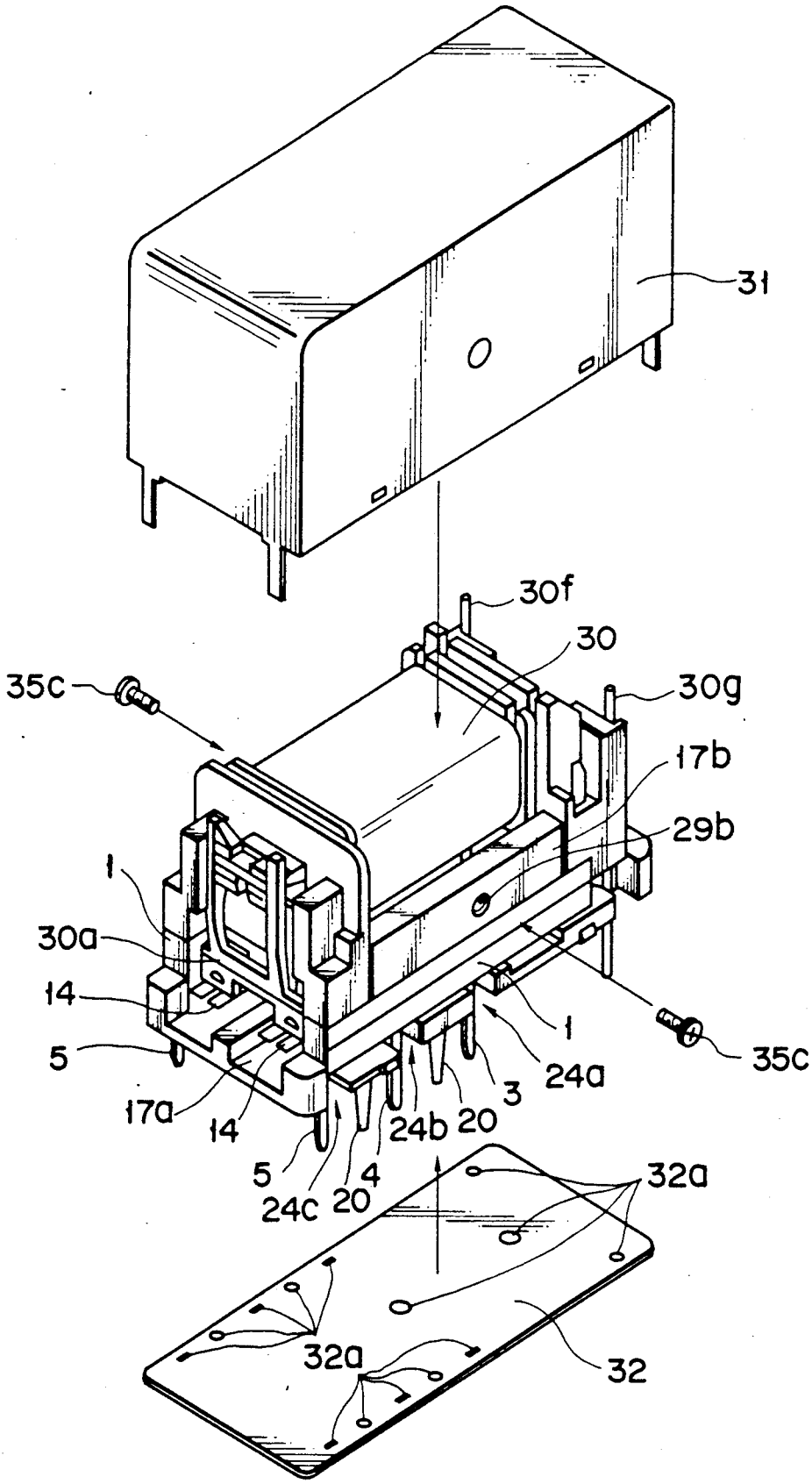
FIG. 5 is an exploded perspective view showing in detail a part IV shown in FIG. 1.

FIG. 5 is an exploded perspective view showing the bottom case assembly part IV shown in FIG. 1. Referring to FIG. 5, reference numeral 32 denotes a flat bottom case in which a predetermined number of holes 32*a* are formed at portions corresponding to the terminals 3, 4, 5, 20, 30*f*, and 30*g*. The bottom case 32 closes the opening edge portion 31*a* of the shielding case 31, and an epoxy resin-based sealing agent is used in order to seal a portion between the bottom case 32 and the shielding case 31. By filling this sealing agent in the through grooves 24*a*, 24*b*, and 24*c*, a change in characteristic impedance at a portion of each the terminals 3, 4, and 5 can be prevented.

An operation of the above arrangement will be described below. As described above, in the RF relay device according to the present invention, the two contact blocks 1 are positioned and stored as a two-transfer type in the single shielding block body 17.

In this manner, by only incorporating the contact blocks 1 in the shielding block body 17, electromagnetic waves of the two contact blocks 1 can be shielded by the shielding wall 21 of the shielding block 17, thereby obtaining isolation therebetween. In addition, these components can be easily assembled.

An RF characteristic impedance at a portion of each of the terminals 3, 4, and 5 of the contact block 1 can be maintained at a predetermined value (e.g., 50 Ω) by a corresponding one of the through grooves 24*a*, 24*b*, and 24*c*. In addition, an RF characteristic impedance at a portion of the stationary contact plates 8 and 9 and the movable contact spring 14 can be maintained at a predetermined value (e.g., 50 Ω).

An electromagnetic field generated by the electromagnet 30 is isolated by the shielding block body 17 consisting of the upper and lower blocks 17*b* and 17*a*. Therefore, the RF characteristic impedance at the portion of the stationary contact plates 8 and 9 and the movable contact spring 14 is not adversely affected.

Furthermore, the contact members 8*a* and 9*a* are provided for the stationary contact plates 8 and 9, respectively, and the contact members 14*a* and 14*b* are provided for the movable contact spring 14. When the movable contact is driven and moved toward either of the stationary contact plates 8 and 9 by the electromagnet 30, the contact member 8*a* or 9*a* is brought into direct contact with the contact member 14*a* or 14*b*, respectively. Therefore, since the durability at these contact portions can be improved, a large number of switching operations can be achieved (1,000,000 times or more: in actual measurement, the number reached 5,000,000 times).

Since the electromagnet 30 for directly driving the movable contact springs 14 can be arranged on the upper surface of the shielding block body 17 or the like, i.e., a position close to the shielding block body 17, the entire RF relay device can be made compact.

In addition, since the two contact blocks 1 (two transfers) can be arranged in a single RF relay device while they are isolated by the shielding wall 21, a large number of contact circuits can be made compact. Therefore, an installation area for RF relay devices of equipment using a large number of RF relay devices can be reduced.

Figure 8:
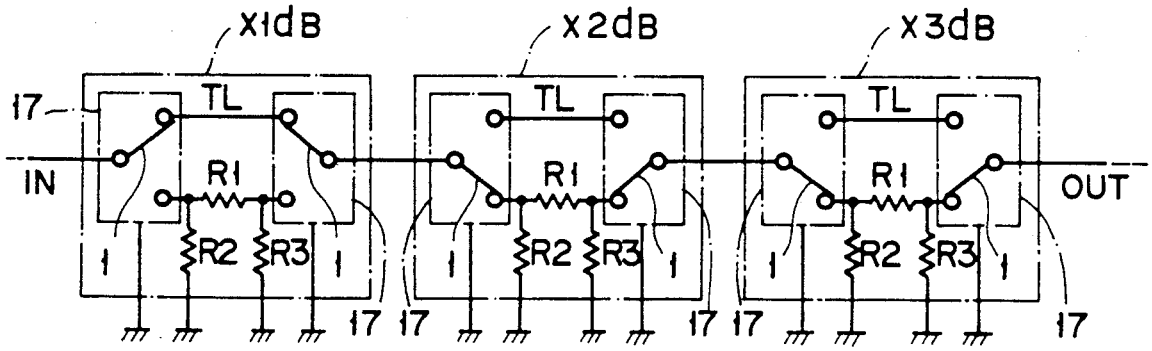
FIG. 8 is a circuit diagram showing an arrangement of a programmable attenuator using the RF relay device shown in FIG. 1.

The RF relay device having the above arrangement can be used at series multi-stage circuit switching portions of a programmable attenuator shown in a circuit diagram of FIG. 8. Since a characteristic impedance can be maintained by the above RF relay device, an RF characteristic impedance of the entire circuit is not adversely affected even when the above RF relay device is used at the multi-stage switching portions.

Figure 9A:
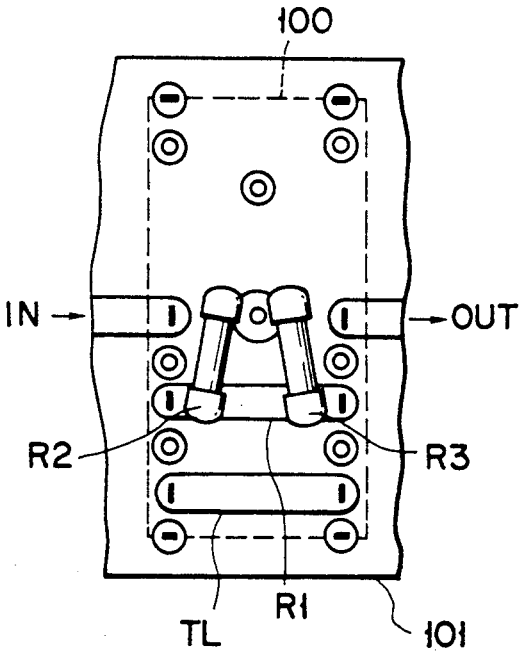
FIGS. 9A and 9B are bottom and side views, respectively, showing a state in which a part shown in FIG. 8 is mounted.
Figure 9B:
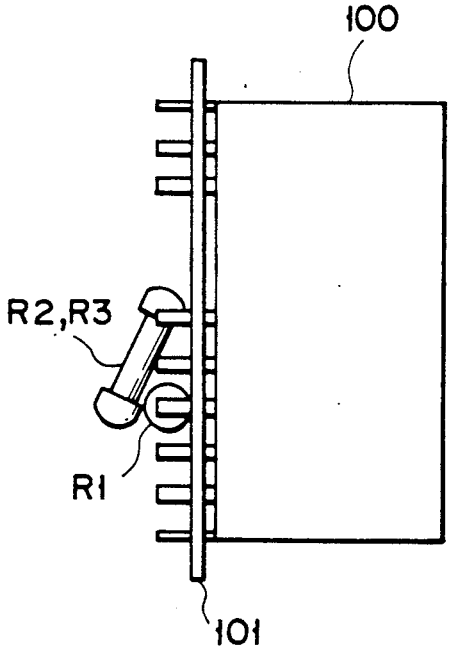

FIGS. 9A and 9B show a state in which an RF relay device 100 applied to the above programmable attenuator is mounted on a printed circuit board 101. An attenuator of this type performs switching between a state in which a signal supplied to an input side (IN) is passed directly to an output side (OUT) via a through line (TL) (through) and a state in which the signal is passed with an attenuation amount of a predetermined step (e.g., 1 dB step) via an attenuating circuit consisting of resistors R1, R2, and R3 (suppression). At this time, if the above RF relay device 100 of the two-transfer type is used, the resistors R1, R2, and R3 can be arranged within an arrangement range of the RF relay device 100, and a connection pattern length to the next stage can be minimized. Therefore, the attenuator can be made much more advantageous than that using a conventional one-transfer type RF relay device.

Another embodiment of the bottom case 32 and a method of sealing the bottom case to the shielding case will be described below.

Figure 10:
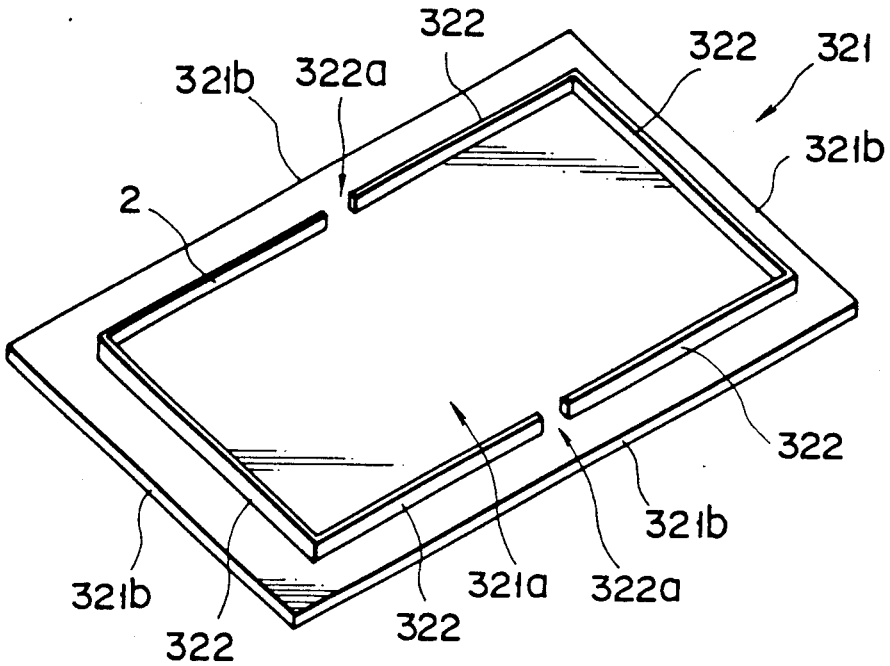
FIG. 10 is a perspective view showing another example of a bottom case shown in FIG. 1.

A bottom case (to be referred to as a thin-plate main body hereinafter) 321 shown in FIG. 10 is molded by a plastic resin and has a thickness of about 0.3 mm.

The thin-plate main body 321 is molded to have a width and length corresponding to an opening portion of a shielding case to be sealed. A projecting portion 322 having a height of about 0.2 mm is continuously formed on one surface 321*a* of the thin-plate main body 321 so as to be separated from an edge portion 321*b* by a predetermined distance.

Notches 322*a* are formed in the projecting portion 322 to have the same thickness as the thin-plate main body 321. The notches 322*a* split a stress produced by the continuous projecting portion 322 upon molding.

That is, if the thin-plate main body 321 does not have the projecting portion 322, a shrinkage ratio obtained after molding is uniform throughout the entire surface because the thin-plate main body 321 is flat, and therefore no warping is caused. The projecting portion 322 is required to regulate a flow of a sealing adhesive. If, however, the projecting portion 322 is continuously formed, a portion having a different shrinkage ratio is produced on the surface of the thin-plate main body 321 to cause warping. Since this warping is split by the notches 322*a*, the thin-plate main body 321 is molded flat. Therefore, the notches 322*a* are preferably formed with predetermined distances therebetween in the continuous projecting portion 322. In this embodiment, since the thin-plate main body 321 is rectangular, the notches 322*a* are formed at central portions along the long sides of the projecting portion 322.

Figure 11:
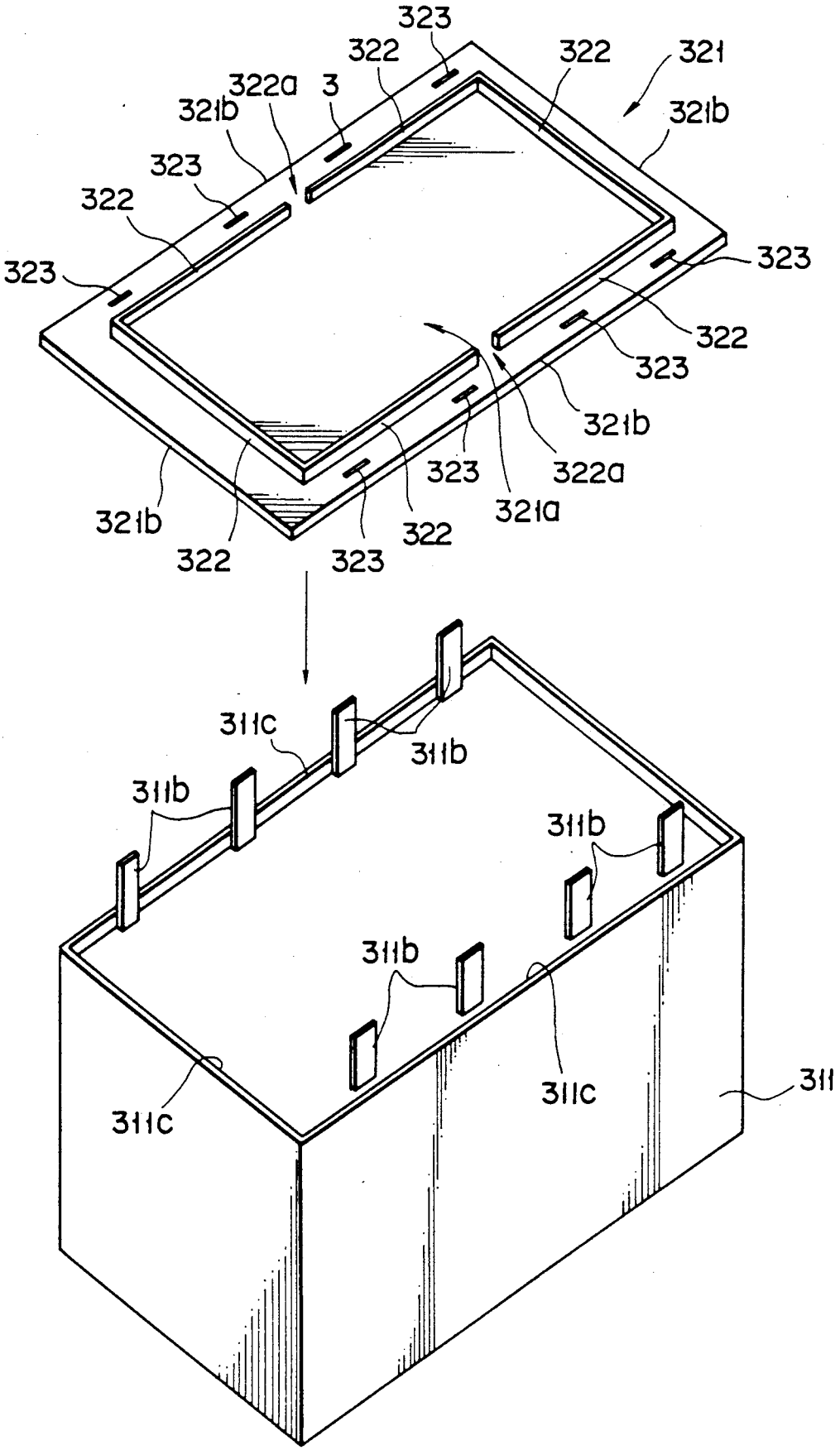
FIG. 11 is an exploded perspective view for explaining sealing of an RF relay device using the bottom case shown in FIG. 10.
Figure 13:
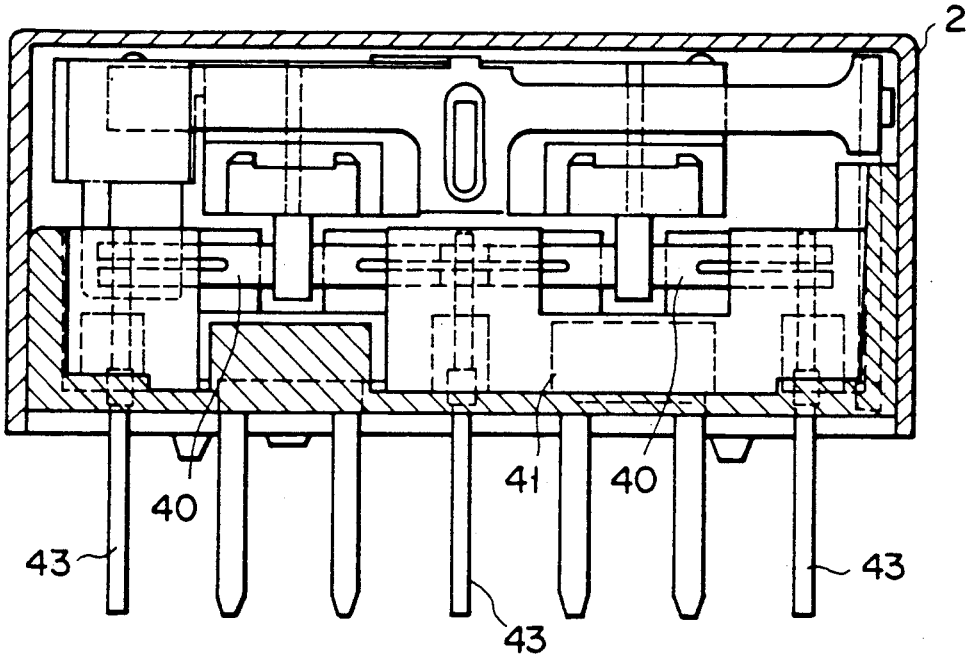
FIG. 13 (PRIOR ART)
Figure 14:
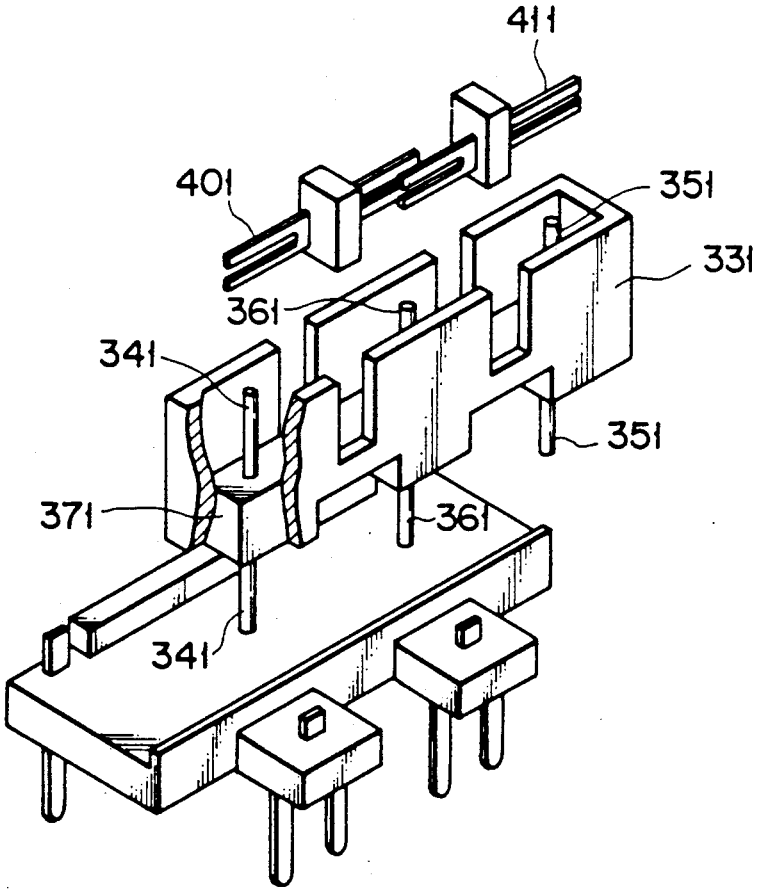
FIG. 14 (PRIOR ART)
FIG. 14 is an exploded perspective view showing a main part of another conventional RF relay device.

A method of sealing an opening portion of a shielding case 311 by using the thin-plate main body 321 will be described below. The thin-plate main body 321 is mounted on the lower surface of the shielding case 311 with the surface having the projecting portion 322 facing down. FIG. 11 is a perspective bottom view of the shielding case 311 and the thin-plate main body 321. These parts are actually assembled in the same direction as the viewing direction of FIG. 11.

Through holes 323 are formed in the thin-plate main body 321 at positions corresponding to terminals 311*b* of the shielding case 311.

An edge portion 311c of the shielding case 311 and the thin-plate main body 321 are sealed by a flow of a sealing agent, but the sealing agent is prevented from flowing further inwardly by the projecting portion 322.

Figure 12:
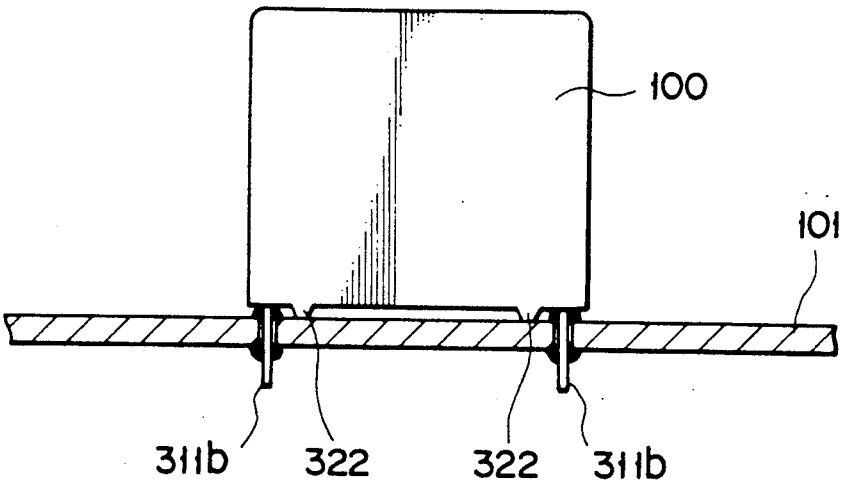
FIG. 12 is a partially cutaway side view showing a state in which the RF relay device shown in FIG. 11 is mounted.

FIG. 12 is a side view showing a state in which an RF relay device 100 completed by sealing the thin-plate main body 321 at the opening portion of the shielding case 311 is mounted on a printed circuit board 101.

When the RF relay device 100 is mounted on the printed circuit board 101, the device 100 slightly floats from the circuit board because the projecting portion 322 projects from the lower surface, thereby easily introducing solder. Therefore, soldering can be easily performed.

As has been described above, according to the RF relay device of the present invention, since the contact members are formed in the contact blocks, the contact members are not abraded after a large number of switching operations. Therefore, an RF relay device having a high durability can be obtained, and switching can be performed a large number of times. In addition, since isolation can be obtained between the contact blocks and between the RF relay device and external equipment, the RF relay device is not easily adversely affected by unnecessary electromagnetic wave interference around the device. Furthermore, according to the present invention, an electromagnet can be located near the contact blocks, and two transfers can be driven with a short distance by a single electromagnet. Therefore, an RF relay device of a two-transfer type which can save an installation space and can be suitably mounted on a printed circuit board is obtained.

In addition, according to the RF relay device of the present invention described above, the shielding block structure is adopted to not only obtain isolation between the contact blocks but also maintain RF characteristic impedances in storage spaces for the contact blocks in the block body and terminal portions at a predetermined value (50 Ω). Therefore, a use frequency band can be extended to an RF band in the order of several GHz (2.2 GHz in actual measurement).

Furthermore, high reproducibility of about 0.02 dB is obtained in actual measurement. Therefore, reliability including the reproducibility can be significantly improved.

What is claimed is:

1. A relay device for switching a radio frequency signal, said device comprising:

first and second contact blocks each having a substantially rectangular insulating member, a pair of stationary contact members projecting inward from said insulating member and supported with a predetermined interval therebetween, a movable contact member arranged between said pair of stationary contact members and supported by said insulating member, and first, second, and third terminals for electrically extracting said pair of stationary contact members and said movable contact member, respectively, and projecting from a base portion of said insulating member with predetermined intervals therebetween;

an electromagnet having a movable member for commonly acting on said movable contact members of said first and second contact blocks to move each movable contact member toward one of said pair of stationary contact members of each of said first and second contact blocks;

a shielding block member with a substantially H-shaped section, having two storage spaces for storing said first and second contact blocks, respectively, a support portion for mounting said electromagnet, and a predetermined number of notched portions for guiding said first, second, and third terminals of each of said first and second contact blocks, at least a surface of said shielding block member being conductive; and a shielding case for shielding at least an edge of an opening portion of said shielding block member.

2. A device according to claim 1, wherein said shielding case is electrically connected to said shielding block member.

3. A device according to claim 1, wherein said movable contact member has a free end extending outward from said storage space of said shielding block member, said movable member of said electromagnet acting on said free end of said movable contact member, so that contact point locations of said movable contact member and said pair of stationary contact members are shielded by said shielding block member and said shielding case.

4. A device according to claim 1, wherein distances from the end faces of said first, second, and third terminals, said pair of stationary contact members, and said movable contact member to said shielding block member and said shielding case are set such that RF characteristic impedances therebetween are substantially unchanged before and after movement of said movable contact member.

5. A device according to claim 1, wherein said shielding block member has first, second, third, and fourth ground terminals arranged between said first, second, and third terminals of each of said first and second contact blocks.

6. A device according to claim 1, wherein said device further comprises a bottom case arranged on a bottom portion of said shielding block member in order to seal the edge of said opening portion of said shielding case.

7. A device according to claim 1, wherein said shielding block member comprises:

a first block member having a projecting portion with a predetermined width at a central portion thereof, step portions in contact with side surfaces of said first and second contact blocks at both ends thereof, and a lower surface portion in contact with upper surfaces of said first and second contact blocks, at least a surface of said first block member having conductivity; and a second block member having projections located at four corners thereof and in contact with end faces of said first and second contact blocks, an upper surface portion in contact with lower surfaces of said first and second contact blocks, a shielding wall for shielding said first and second contact blocks, notched portions for receiving said terminals of said first and second contact blocks, and a plurality of ground terminals projecting in the same direction as said terminals of said first and second contact blocks and connected to a common potential upon operation, said second block member being connected to said first block member to form a substantially H-shaped section with an upper surface of said shielding wall being in contact with a lower surface or said projecting portion of said first block member, and at least a surface of said second block member having conductivity.

8. A device according to claim 1, wherein said electromagnet comprises a coil bobbin having a hollow portion, a coil wound around said coil bobbin, a yoke to be inserted in said hollow portion of said coil bobbin, an armature flexibly supported at one end of said yoke, a distal end of said armature extending from said hollow portion at the other end of said yoke, and a movable member supported at said distal end of said armature and moving in substantially the same direction as an attracting direction of said armature with respect to said yoke.

9. A device according to claim 6, wherein said bottom case has a very-thin-plate structure molded from a plastic resin material and comprises:

a thin-plate main body formed flat to have a predetermined thickness;

a projecting portion projecting from at least one surface of said thin-plate main body and continuously formed along an edge portion of said thin-plate main body so as to be separated inward from said edge portion by a predetermined distance; and notches formed in part of said projecting portion.

10. A relay device comprising:

first and second electrical contact means each having at least a pair of movable contact members and a stationary contact member which can be contacted to or separated from each other;

driving means having a movable member for commonly applying a driving force to each of said movable contact members of said first and second electrical contact means in order to bring into contact or separate each of said movable contact members to or from each of said stationary contact members;

shield mounting means formed to have a substantially H-shaped section and being conductive on at least a surface thereof for storing said first and second electrical contact means such that said first and second electrical contact means are electrically isolated and for mounting said driving means; and shielding means for shielding at least an edge of an opening portion of said mounting means.

11. A high frequency relay device comprising:

first and second contact blocks each having an insulating member integrally incorporating a pair of stationary contact plates, a movable contact spring movable between said pair of stationary contact plates to open or close a switch, and a plurality of terminals for electrically extracting said stationary contact plates and said movable contact spring, and having a contact member at a contact portion of each contact;

an electromagnet having a movable member for displacing a free end of said movable contact spring of each of said first and second contact blocks toward one of said stationary contact plates;

a shield block member formed to have a substantially H-shaped section, having a plurality of ground terminals integrally formed on and projecting in the same direction as said terminals from a lower surface thereof and connected to a common potential upon operation, having an electromagnet on an upper surface thereof, and storing said first and second contact blocks in first and second storage spaces formed therein, respectively, and having a shielding wall for isolating said first and second contact blocks; and a conductive shielding case for covering the outer surfaces of said first and second contact blocks, said electromagnet, and said shield block member.

12. A device according to claim 11, wherein said shield block member and said shielding case are electrically connected with each other by connecting means.

13. A device according to claim 11, further comprising a bottom case, arranged on a lower surface of said shield block member, for closing an opening portion between said bottom case and a peripheral portion of said shielding case.

14. A shielding block structure for switching a radio frequency, comprising:

first and second contact blocks each having an insulating member integrally incorporating a pair of stationary contact plates, a movable contact spring movable between said pair of stationary contact plates to open or close a switch, and a plurality of terminals for electrically extracting said stationary contact plates and said movable contact spring; and a block member formed to have a substantially H-shaped section providing first and second storage spaces for electrically isolating and storing said first and second contact blocks, and having through grooves for receiving terminals of said first and second contact blocks and having a plurality of ground terminals projecting in the same direction as said terminals of said first and second contact blocks to be stored and connected to a common potential upon operation, said through grooves and said ground terminals being formed integrally with said block member, and at least a surface of said block member being conductivity, wherein predetermined intervals are maintained from said stationary contact plates and said movable contact springs to the opposing block member and from said terminals of said first and second contact blocks to the opposing block member in said first and second storage spaces, thereby maintaining a predetermined characteristic impedance and wherein electromagnetic waves are shielded between said first and second contact blocks stored in said first and second storage spaces, respectively.

15. A structure according to claim 14, wherein said block member includes step portions and projections to define storage positions of said first and second contact blocks, thereby maintaining the predetermined characteristic impedance.

16. An attenuator using a radio frequency relay device, said attenuator comprising:

a radio frequency relay device including a first contact block having first, second, and third terminals for electrically extracting a pair of stationary contact members and a movable contact member, respectively, and a second contact block having fourth, fifth, and sixth terminals for electrically extracting a pair of stationary contact member and a movable contact members, said first, second, and third terminals being arranged parallel to said fourth, fifth, and sixth terminals;

an input line connected to said third terminal for extracting said movable contact member of said first contact block;

a through line directly connected between said first terminal for extracting one of said stationary terminals of said first contact block and said fourth terminal for extracting one of said stationary contact members of said second contact block;

an attenuating circuit including a plurality of resistors connected between said second terminal for extracting the other stationary contact member of said first contact block and said fifth terminal for extracting the other stationary contact member of said second contact block; and an output line connected to said sixth terminal for extracting said movable contact member of said second contact block.

* * * * *